United States Patent [19]

Carlson

[11] Patent Number: 4,543,148

[45] Date of Patent: Sep. 24, 1985

[54] ADHESIVE DISPENSING SYSTEM

[75] Inventor: Chester O. Carlson, Salem, Mass.

[73] Assignee: Illinois Tool Works Inc., Chicago, Ill.

[21] Appl. No.: 623,694

[22] Filed: Jun. 22, 1984

[51] Int. Cl.[4] ..... A61M 5/315

[52] U.S. Cl. ..... 156/314; 156/578; 222/137; 401/17; 401/19; 401/176; 401/182; 401/202; 604/226

[58] Field of Search ..... 156/578, 314; 401/16–19, 23–24, 36, 47, 171, 176, 182, 202; 604/226, 193; 222/94, 137; 128/763

[56] References Cited

U.S. PATENT DOCUMENTS

| | | | |
|---|---|---|---|
| 1,154,677 | 9/1915 | Wedig | 604/226 |
| 2,728,341 | 12/1955 | Roehr | 604/226 X |
| 2,742,041 | 4/1956 | Lipari | 604/226 X |
| 3,161,904 | 12/1964 | Goldich | 401/23 |
| 4,213,456 | 7/1980 | Bottger | 604/226 |

*Primary Examiner*—David Simmons

*Attorney, Agent, or Firm*—J. R. Halvorsen; T. W. Buckman

[57] ABSTRACT

A prepackaged dispensing system for a two part permanent adhesive including an adhesive portion and an activator portion. The adhesive portion is housed in the main hollow body of a syringe-like member between an initially closed discharge means end and a sealing piston initially spaced axially form said discharge means end. A removably capped elongated dispensing container, adapted to contain and dispense the activator portion, is telescopically positioned within the hollow body and engages the piston. The combined total axial length of the piston and dispensing container when aligned exceeds the internal length of the hollow main body whereby axial pressure on said container will move said piston and insures substantially total discharge of said adhesive by movement of said piston to the discharge end of said hollow body.

13 Claims, 5 Drawing Figures

FIG. 3
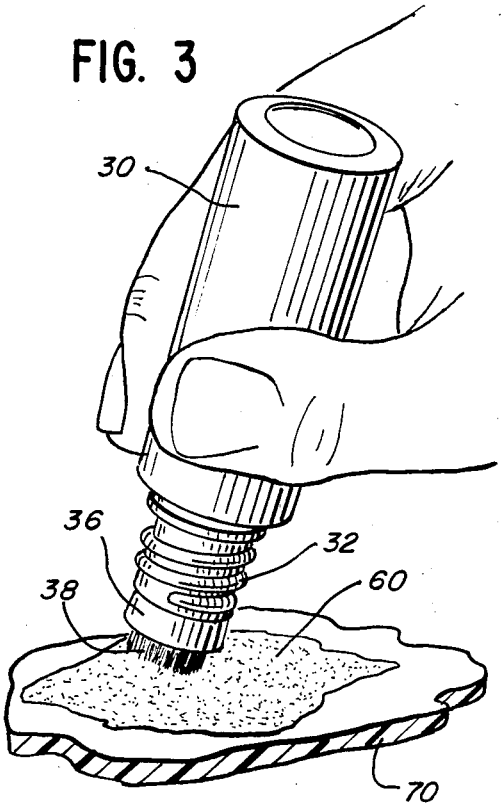
FIG. 4
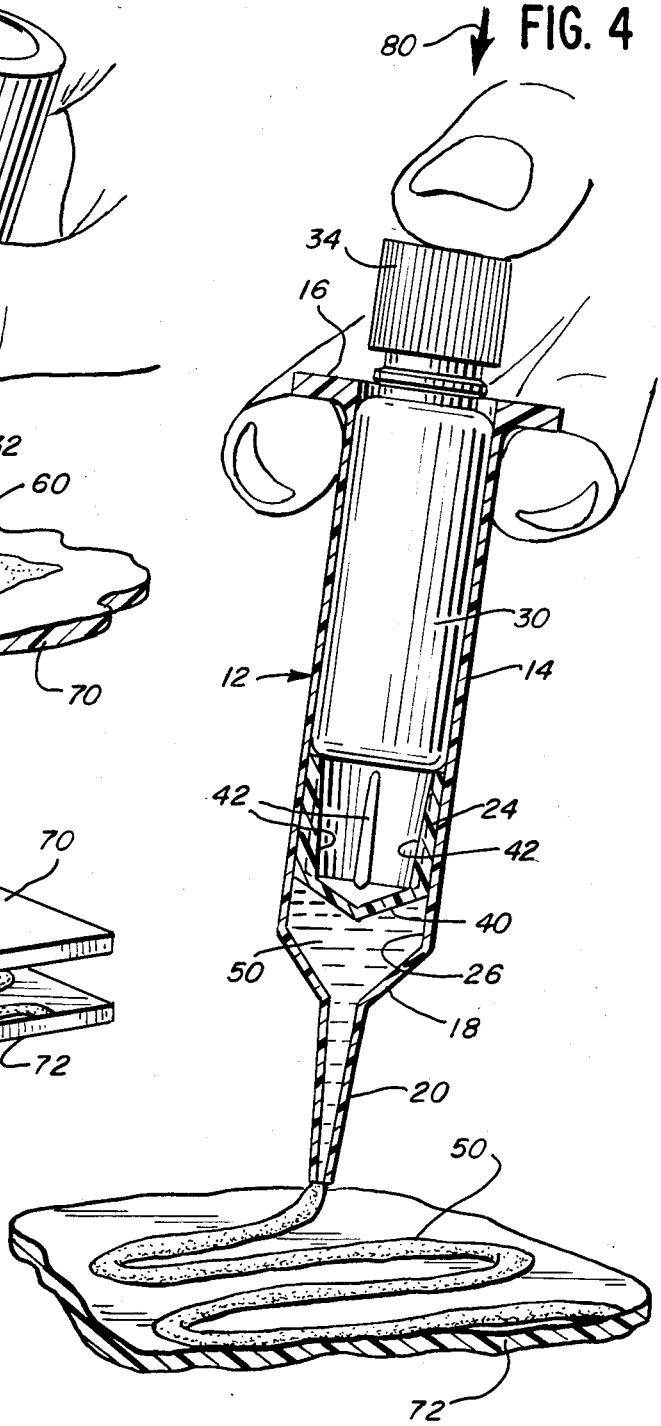
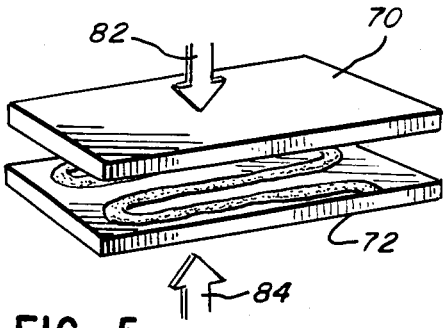
FIG. 5

ADHESIVE DISPENSING SYSTEM

This invention relates to an adhesive dispensing packaging system and more specifically relates to a syringe-like member having an open ended hollow main body, a hollow tapered portion at one end terminating and communicating with a nozzle-like discharge end, a piston sealingly complimentary to the interior of said main body, an elongated capped container that can be removably positioned within said main body and capable of actuating movement of said piston in the direction of said discharge end for purposes of dispensing material stored in said main body to ambient through said nozzle-like end. Said container includes a liquid dispensing means for application of an activator for said adhesive to be applied to the workpiece prior to application of the adhesive and capable of activating the adhesive when the workpiece portions are brought into juxtaposition.

BACKGROUND OF THE INVENTION

The prior art is replete with examples of multiple use syringes. For example, the U.S. Pat. No. 400,491 to Ross shows the use of a plunger and cap for storing medicine tablets which are removed from the plunger and inserted into the syringe, the plunger is then reinserted and water or a similar solvent is aspirated into the syringe. The entire assembly is shaken to dissolve the tablet and then dispensed by application of an axial force to the plunger.

A patent to Wedig U.S. Pat. No. 1,154,677 is somewhat related to the above Ross patent except that Wedig stores the "dis-solvent" in his plunger and stores his medicament in his syringe, the seal of the plunger is removed and its contents poured into the syringe to dissolve the medicament. The plunger is then returned to the syringe to act as its piston for discharge of the dissolved medicament.

The later patents to Weguelin et al U.S. Pat. No. 1,272,742 and Wedig U.S. Pat. No. 1,503,219 are variations on the same theme in that the tablet, powder or solvent can be stored in the plunger and provided access to the syringe and then dispensed through the nozzle end.

A more recent patent to Bottger U.S. Pat. No. 4,213,456 describes a device which attempts to provide a multipurpose instrument which can be used for a multiplicity of purposes. Even with the wide variety of applications that Bottger proposes, he does not include the specifics nor the singularity of purpose of the present invention.

SUMMARY OF THE INVENTION

The present invention has as its object the provision of a self-contained two system adhesive applicating device in which a predetermined quantity of adhesive is stored in a syringe-like member having a removably capped elongated nozzle-like end and a piston positioned in spaced relation to the nozzle-like end to form a chamber for acceptance of the predetermined quantity of adhesive. A cap is provided for the nozzle end so that the adhesive can have an extended shelf life. An elongated complimentary container capable of being accepted within the syringe and having adequate length to serve as a motivating means for movement of the piston by application of an axial force to the elongated container. One end of the container is open and includes a liquid dispensing means, the preferred embodiment illustrating a dauber-type of dispenser and a removable cap which can be replaced after use of the dauber. After application to at least one of two workpieces of the activator by the dauber, the cylinder closure is replaced and retelescoped with the syringe to serve as a dispenser for the predetermined quantity of adhesive located therein. When the workpieces are brought together, the activator works on the adhesive and a permanent bond is developed when the activator and adhesive are brought into juxtaposed relationship.

A further object is to provide a simple, easily operated device which can be economically produced.

Still another object of the present invention is to permit the use of a limited quantity of the activator and adhesive, resealing the nozzle with its appropriate removable, replaceable cap and also replacing the closure on one end of the container of activator so that it too can be preserved for later applications.

Still another object is to provide a hermetically sealable pouch to increase the shelf life of the system and additionally the system is provided with a semi-rigid elongated container to prevent physical or mechanical damage to the syringe-like body and applicator.

Other objects will become apparent to those skilled in the art when the accompanying drawing is read with the specification.

DETAILED DESCRIPTION OF THE DRAWINGS

FIG. 3 is a perspective view of the applicator-plunger in use distributing activator on a workpiece;

FIG. 4 is a perspective view in partial section showing the primary embodiment of this invention applying adhesive to a workpiece; and FIG. 5 shows one manner of bringing the workpieces together for activation of the adhesive for a permanent bond.

DETAILED DESCRIPTION OF THE INVENTION

Figure 1:
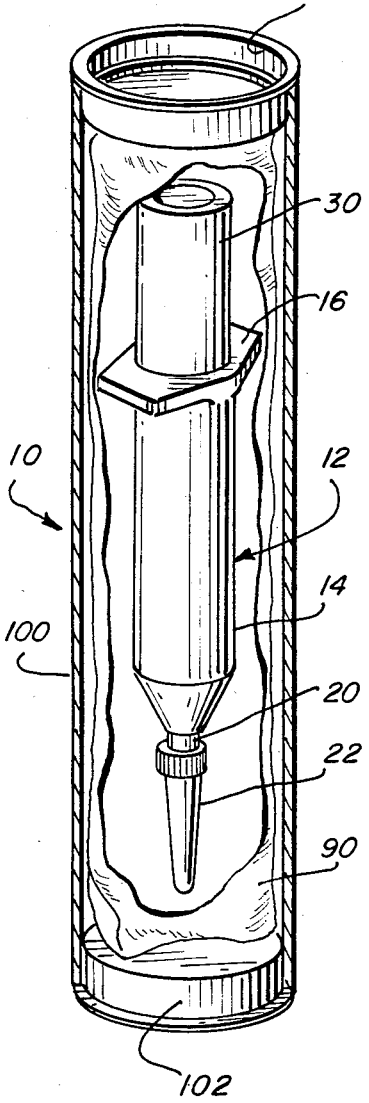
FIG. 1 is a vertical elevational view in partial section cut away to show the packaging system of the present invention.

Referring now to the drawings wherein similar numerals are utilized to designate similar parts the two-part adhesive dispensing packaging system 10 contemplated by the present invention includes a syringe-like member 12 having an open ended hollow main body 14 with finger gripping flanges 16 disposed adjacent its open end. At the opposite end it is provided with a tapered portion 18 terminating and communicating with the bore of a thin nozzle-like discharge end 20. A suitable tapered cap 22 is provided for closing the bore of the discharge end 20. It should be recognized that an internal plug would serve equally as well for such purposes of closure.

Figure 2:
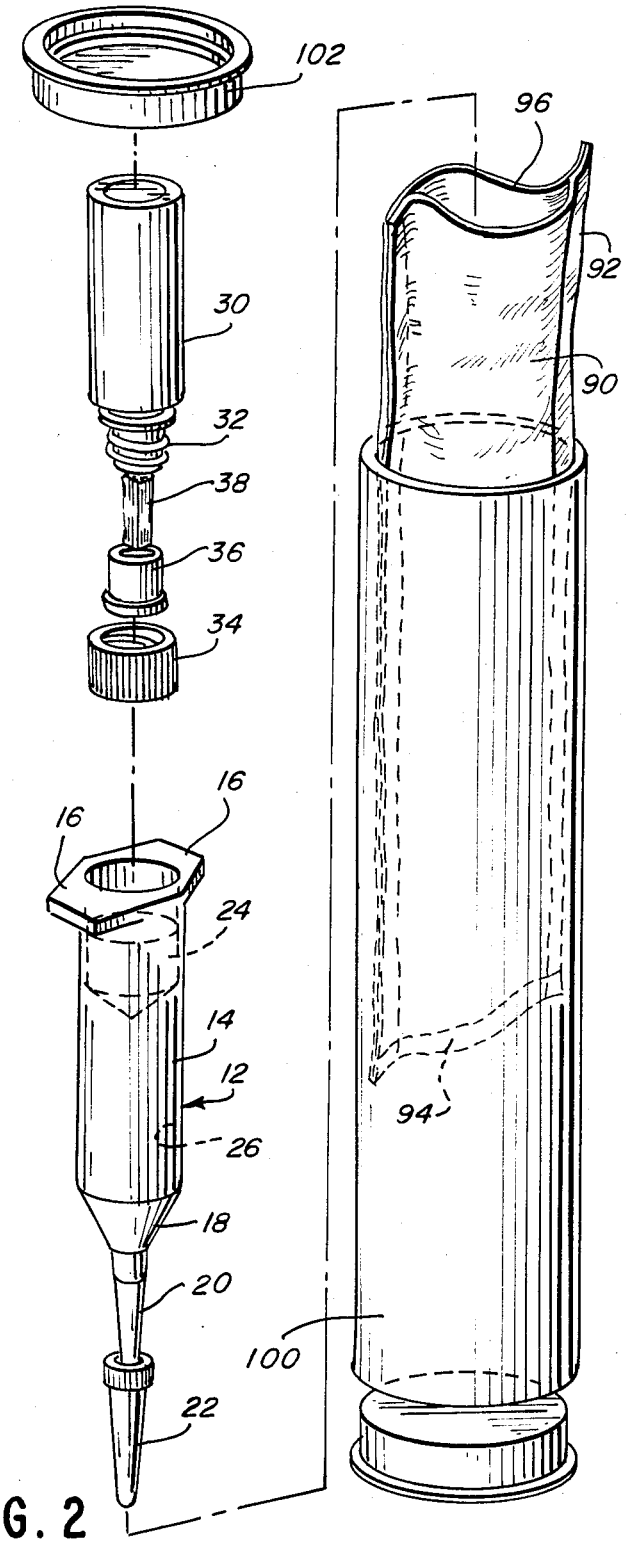
FIG. 2 is an exploded view of the various elements making up the present invention.

Positioned internally of the hollow body 14 is a cup-shaped piston 24 which can be positioned at predetermined points within the hollow body to form a chamber 26 defined by the lower end of the piston 24, as seen in FIG. 2, and the discharge end 20. This chamber 26 is designated to accept a predetermined amount of adhesive and with the sealing piston 24 and the cap 22 the adhesive is maintained in a usable condition for the necessary shelf life required.

Normally positioned coaxial with the interior of the hollow body 14 is an elongated activator container 30 provided with suitable means, in the present instance screw threads 32, for acceptance of a cap or closure 34. In the present embodiment there also is provided within the threaded neck 32 a secondary closure retainer 36 having a hollow bore adapted to accept a dauber-like wick 38 which projects outwardly of the secondary closure 36 when the cap closure 34 is removed. The container 30 is complimentary to the interior of the hollow body 14 and while a cylinder is the preferred form it will be recognized that the syringe body 14 and the container could be polygonal in cross-section with the container 30 being complimentary thereto. The threaded neck 32 is reduced in diameter relative to the diameter of the container 30 so as to accommodate the cap-closure 34 which has a similar complimentary diameter to the interior of the hollow body 14. Thus, the container 30 can be introduced into the syringe-like hollow body 14 in either direction and still serves its intended secondary function.

That secondary function of container 30 is to serve as the plunger for activation of the piston 24. The piston 24 is basically a cup-shaped device having a closed end 40 that is tapered with a slightly more shallow angle of inclusion than the tapered portion 18 of the syringe 12. The diameter of the piston 24 is such as to sealingly engage the interior wall of the hollow body 14. The piston 24 is suitably reinforced as by axially extending ribs 42 which are circumferentially spaced about the interior of the piston. The end of the container 30 and/or the cap-closure 34 are preferably substantially perpendicular to the axis thereof so as to provide a firm circumferential pressure against the end of the piston 24. It will be noted that the combined axial extent of the piston 24 and the container 30 with cap 34 are greater than the axial extent of the hollow body 14 and tapered end 18, whereby, the activator container 30 with its closure 34 can be used as a plunger to discharge all of the adhesive 50 contained in the chamber 26.

Referring back to FIG. 3, the cylinder 30 contains a liquid activator 60 which can be applied by inverting the container, removing its cap 34 and either daubing broad areas of the workpiece 70 with the activator 60 or alternatively striping the activator 60 in a network of lines (not shown). The activator 60 must be applied to at least one of the workpieces 70. After the activator is applied the cap 34 is replaced to sealingly cover the dauber 38 and then the cylindrical container 30, either with its closed end or with the cap 34 is telescoped into the hollow body 14, as seen in FIG. 4. The syringe and container assembly is gripped by the users fingers and thumb and an axial force, represented by the arrow 80, is applied to the end to move the piston 24 toward the nozzle-like discharge end 20 to spread the adhesive 50 on at least one of the workpieces, in this instance the second workpiece 72.

As seen in FIG. 5 the two workpieces 70 and 72 each carry either the activator or the adhesive and when brought into juxtaposed relationship, as illustrated by the force arrows 82 and 84 respectively, the activator and adhesive are brought together and a permanent bond realized. It will be appreciated that in some instances the activator is applied to both workpieces 70 and 72 and the adhesive 50 can be applied to both workpieces as well.

To complete the system, the telescopically assembled activator container 30 and syringe 12 are initially telescopically packaged within a hermetically sealed pouch, such as a foil lined bag 90 capable of being sealed along its opposed edges 92 and at both ends 94 and 96, the latter end 96 being shown open in FIG. 2, prior to insertion of the assembly therein. For further protection the pouch 90 is enclosed within a substantially rigid tubular member 100 having end caps 102, at least one of which is removable, for protecting the mechanical and structural integrity of the device. It will be recognized that while a cylindrical tube 100 is shown in this embodiment other configurations such as polygons or other box-like members having either independent or integral closure means at the ends can be utilized to protect the physical structure of the system.

To utilize this system the container 100 is opened at one or both ends 102, the pouch 90 removed therefrom and cut open or ripped open to provided access to the telescopically assembled syringe 12 and container 30. The surfaces of workpieces 70 and 72 that are to be bonded are cleaned by suitable means and the cylinder 30 is removed from the hollow body 14.

Removal of the cap 34 exposes the wick-like dauber 38 and the activator 60 is permitted to escape therefrom by contact with surface of the workpiece 70. After a suitable area is treated the cap 34 is replaced on threaded neck 32 to seal the open end of cylinder 30 and it is then telescopically reassociated with the hollow body 14.

Axial pressure, as shown by arrow 80, causes the piston 24 to move toward the nozzle-like discharge end 20 from whence the cap 22 has been removed, and the adhesive 50 is discharged from the bore of the nozzle-like discharge end 20, as shown on workpiece 72 in FIG. 4. The two workpieces 70 and 72 which have either singly or both been treated by the activator and adhesive are brought together to bring the activator 60 and adhesive 50 into juxtaposed relation thereby insuring a permanent bond between the workpieces 70 and 72. While the workpieces are indicated as being plastic, it should be recognized that this system is also applicable to adhesives used for bonding other materials such as wood, fiberboard and metals.

While variations from the above will be apparent to those skilled in the art it is intent that I be limited only by the appended claims.

I claim:

1. A system for bonding plastic and/or metal workpieces by utilization of a two part permanent adhesive including sealable packaging means containing: a syringe member having a delivery end and an actuating end, a piston positioned in said syringe and spaced from said delivery end to form a cavity having a predetermined volume, said cavity housing an adhesive material, a capped elongated container having a complimentary external configuration and adapted to be accepted within the actuating end of said syringe, said container housing an activator for use with said adhesive, said container including means for dispensing said activator onto one or more of said workpieces, said piston and said capped container having a combined axial length greater than said syringe, said capped container telescoped within said syringe and mating with and capable of moving said piston when an axially directed force is applied to the exposed end of said container to eject said adhesive material from said delivery end of said syringe onto a workpiece in a position that will be in juxtaposition to said activator on it or another workpiece to be joined thereto.

2. A system of the type set forth in claim 1 wherein said activator is applied to only one workpiece.

3. A system of the type set forth in claim 1 wherein said activator is applied to both workpieces.

4. A system of the type set forth in claims 2 or 3 wherein said adhesive is applied to one workpiece on top of said activator.

5. A system of the type set forth in claim 2 wherein said adhesive is applied to the other workpiece in a location that will be juxtaposed to the location on the first workpiece carrying the activator.

6. A system of the type set forth in claim 1 wherein said activator container includes a removable cap on one end that is generally complimentary to the interior of said syringe.

7. A system of the type set forth in claim 1 wherein said activator is a liquid and said container includes liquid dispensing means.

8. A system of the type set forth in claim 7 wherein said container includes a wick-like dauber that is adapted to apply a light coat of liquid activator to a workpiece.

9. A system of the type set forth of claim 1 wherein said piston is a hollow tapered cup means sealingly engaging the side wall of the syringe and movable by said container in only one direction toward the dispensing end of said syringe.

10. The method of applying an adhesive and its activator including the steps of packaging a predetermined amount of said adhesive in a syringe between its discharge end and a movable piston, packaging a predetermined amount of said activator in an end dispensing cylinder having a removable closure over said end, said cylinder and closure being complimentary to said syringe and piston and being adapted to be telescoped into said syringe, whereby upon application of an axial force to said cylinder it will move said piston and cause the discharge of said adhesive from said syringe, said container being removable from said syringe and said closure removed and activator applied to at least one of two workpieces to be joined, said closure replaced on said cylinder and retelescoped into said syringe, an axial force is then applied to said closed cylinder to move said piston discharging said adhesive into application on a surface of at least one of said two workpieces to be joined in a location where it will be juxtaposed to said activator when said two workpieces are brought into superposed relation, thereby providing the user with a compact pre-measured adhesive and activator in an easily usable method for dispensing and application of the materials to workpieces to be joined.

11. The method as set forth in claim 10 wherein said syringe includes a closure at its discharge end, removal of said closure taking place prior to discharge of said adhesive.

12. The method as set forth in claim 10 wherein said cylinder includes a wick-like dauber and said method of applying said activator is by intermittent daubing.

13. The method as set forth in claim 10 wherein said cylinder includes a wick-like dauber and said method of applying said activator is by laying down a network of stripes of activator on at least one of said workpieces for interaction with said adhesive when said workpieces are brought into assembled relationship.

* * * * *